US008714875B2

(12) United States Patent
Morii et al.

(10) Patent No.: US 8,714,875 B2
(45) Date of Patent: May 6, 2014

(54) MOORING DEVICE FOR FLAP-GATE BREAKWATER

(75) Inventors: Toshiaki Morii, Osaka (JP); Kyouiti Nakayasu, Osaka (JP); Yuitirou Kimura, Osaka (JP)

(73) Assignee: Hitachi Zosen Corporation, Osaka (JP)

( * ) Notice: Subject to any disclaimer, the term of this patent is extended or adjusted under 35 U.S.C. 154(b) by 171 days.

(21) Appl. No.: 13/505,527

(22) PCT Filed: Sep. 3, 2010

(86) PCT No.: PCT/JP2010/065145

§ 371 (c)(1),
(2), (4) Date: May 2, 2012

(87) PCT Pub. No.: WO2011/065086

PCT Pub. Date: Jun. 3, 2011

(65) Prior Publication Data

US 2012/0219360 A1 Aug. 30, 2012

(30) Foreign Application Priority Data

Nov. 24, 2009 (JP) ..... 2009-266451

(51) Int. Cl.
*E02B 7/42* (2006.01)

(52) U.S. Cl.
USPC ..... 405/100; 405/28; 210/170.1

(58) Field of Classification Search
USPC ..... 405/21, 28, 87, 92, 99, 100; 210/170.1
See application file for complete search history.

(56) References Cited

U.S. PATENT DOCUMENTS

| | | | | | |
|---|---|---|---|---|---|
| 4,836,711 | A * | 6/1989 | Sala et al. | ..... | 405/92 |
| 5,171,102 | A * | 12/1992 | De Wit | ..... | 405/101 |
| 5,178,490 | A * | 1/1993 | Snowberger et al. | ..... | 405/102 |
| 5,433,555 | A * | 7/1995 | Parizot | ..... | 405/100 |
| 5,984,575 | A * | 11/1999 | Knott, Sr. | ..... | 405/92 |
| 6,623,209 | B1 * | 9/2003 | Waters, Jr. | ..... | 405/94 |
| 8,366,348 | B2 * | 2/2013 | Morii et al. | ..... | 405/100 |
| 2007/0253744 | A1 * | 11/2007 | Schlageter et al. | ..... | 399/258 |

FOREIGN PATENT DOCUMENTS

| | | | |
|---|---|---|---|
| JP | 02-204515 | A | 8/1990 |
| JP | 2003-227125 | A | 8/2003 |
| JP | 2004-003238 | A | 1/2004 |

OTHER PUBLICATIONS

International Preliminary Report on Patentability in corresponding International Application No. PCT/JP2010/065145, dated Jun. 21, 2012, 5 pages.
International Search Report for International Application No. PCT/JP2010/065145, dated Dec. 7, 2010, 1 page.

* cited by examiner

*Primary Examiner* — Benjamin Fiorello
*Assistant Examiner* — Kyle Armstrong
(74) *Attorney, Agent, or Firm* — Brinks Gilson & Lione

(57) ABSTRACT

The invention is for a mooring device (11) for a flap-gate breakwater (1) having a water blocking door body (2) that pivots about a horizontal axis. The mooring device (11) comprises a mooring hook (15) that controllably engages and disengages a gate mooring member (2*b*) of the door body (2) during mooring and raising operations. The mooring hook (15) is operated by a control device (21), making it possible to adjust the mooring hook position in a short period of time.

2 Claims, 9 Drawing Sheets

(a)

(b)

(a)

(b)

(a)

(b)

MOORING DEVICE FOR FLAP-GATE BREAKWATER

This application is a 371 application of PCT/JP2010/065145 having an international filing date of Sep. 3, 2010, which claims priority to JP2009-266451 filed Nov. 24, 2009, the entire content of which is incorporated herein by reference.

TECHNICAL FIELD

The present invention relates to a device which moors a door body of a flap-gate breakwater which is placed in a harbor as a countermeasure against high tide, for example.

BACKGROUND ART

In a flap-gate breakwater of the prior art, the door body was raised or lowered by buoyancy (e.g., Patent Reference 1).

The prior art flap-gate breakwater raised the door body by supplying air to a buoyancy chamber provided to the door body, thereby discharging sea water from the buoyancy chamber, so it needed an air supply device to supply air to the buoyancy chamber and discharge water from the buoyancy chamber.

However, in order to be able to supply compressed air during an electricity breakout, the prior art flap-gate breakwater constantly required a reservoir of compressed air in an accumulator tank. It was also necessary to constantly monitor the pressure of the accumulator tank, the overturning moment of the door body (weight of the end of the door body), and the angle of inclination of the door body, because the buoyancy chamber of the door body fills with sea water when it is being contained, and the door body rests in the containment position because of its weight. However, in this case, it is impossible to detect abnormalities such as the formation of holes in the buoyancy chamber due to corrosion or the like. Moreover, if the weight of the door body increases due to sediments or the like, maintenance becomes burdensome, since it is necessary to maintain buoyancy operations or dredging.

If a tsunami warning is sounded during an earthquake and a breakwater is raised, it can take a long time to raise the breakwater, because an air supply valve is opened to supply air to the buoyancy chamber and water is discharged from the buoyancy chamber based on levitation instructions, and this can occur too late to block the influx of a tsunami.

Accordingly, the applicants had previously disclosed a mooring device which constantly held a door body in a buoyant state in a flap-gate breakwater in which the door body rises due to buoyancy (Japanese Patent Application No. 2008-307699).

In this prior art mooring device for a flap-gate breakwater, an operation of a mooring hook positioned in the water was carried out, using a mooring rope operated from land. Therefore, in order to maintain secure mooring conditions, the position of the mooring hook had to be adjusted if the mooring rope was stretched due to the passage of time or by seasonal changes, and such an adjustment takes a long time.

In addition, if the mooring rope stretched and needed to be replaced, the operation of attaching the end of the rope to the mooring hook had to be carried out under water.

Patent Reference 1: Japanese Patent Application Kokai Publication No. 2003-227125

SUMMARY OF THE INVENTION

Problems to be Solved by the Invention

The prior art problems to be solved by the present invention are: (1) It takes a long time to adjust the position of the mooring hook in response to changes in the mooring rope (stretching), in order to maintain secure mooring conditions; and (2) The operation of replacing the mooring hook must be carried out under water, because the mooring hook side of the mooring rope is under water.

Means for Solving these Problems

In order to avoid taking a long time to adjust the mooring hook position, and in order to avoid the operation of positioning the rope under water, the mooring device for a flap-gate breakwater according to the present invention provides a door body which has a plurality of sets of door body blocks arranged in a width direction, and is moored in a state of buoyancy, and is raised by releasing the mooring.

The mooring device according to the present invention comprises:

- a torque shaft disposed so as to freely rotate around a central axis, in a position opposite to a gate mooring member attached to the backside of the door body in a mooring state;
- a mooring hook installed on the torque shaft to protrude in a position to engage with the gate mooring member;
- a counterweight attached to the torque shaft for rotating the torque shaft in a direction to release the mooring hook from engaging with the gate mooring member;
- a first link member disposed, in a containment structure which moors the door body under water, on a portion opposite to the backside of the door body in a mooring state;
- a second link member disposed in the containment structure on the outer side of one end side of the backside of the door body in the mooring state;
- a rod member having one end connected in a position toward the other end of a torque arm with one end attached to the torque shaft, and having the other end pulled above the surface of the water via the two link members;
- a hook attaching and detaching cylinder device disposed near the other end of the rod member and having a pulley attached to the front end of a piston rod;
- a wire member, one end of which is connected to the other end of the rod member, and the other end of which is connected via a pulley to a spring device which expands and contracts together with the oscillation of the door body; and
- a first vertical rod forming the rod member, one end of which pivots at a position toward the other end of the torque arm, and the other end of which pivots at the one end of the first link member, and the first vertical rod having a slot at one end and a spherical bushing at the other end, wherein when it is time to activate mooring of the door body, while oscillating around the spherical bushing oscillating as a supporting point, a pin attached to a position toward the other end of the torque arm is allowed to move along the slot to accommodate vertical movements of the mooring hook, from the time when the gate mooring member starts to press down on the front end of the mooring hook, until the time when the front end of the mooring hook crosses the gate mooring member.

The present invention makes it possible to compensate for stretching of the rod member by raising and lowering the wire member which connects a spring device which expands and contracts together with the oscillation of the door body to the other end of the rod member which is used instead of a mooring rope, via a pulley attached to the front end of the piston rod of the hook attaching and detaching cylinder device.

Advantageous Effects of the Invention

The present invention makes it possible to compensate if stretching occurs in the rod member by raising and lowering the wire member which connects a spring device which expands and contracts together with the oscillation of the rod member and the door body, via a pulley attached to the piston rod of the hook attaching and detaching cylinder device.

In addition, the mooring operation can be carried out with only a mooring hook and a counterweight, due to the fact that a slot is provided at one end of the first vertical rod which connects the torque arm and the first link member, and the spherical bushing is provided at the other end. Thus, there is no longer a need for a series of actions pertaining to the mooring operation to be performed by a device located on land, and it is possible to reduce the stroke of the hook attaching and detaching cylinder device. Moreover, there is no need to move the link members and the rod members with a counterweight, because a series of mooring operations can be carried out irrespective of the link members and the rod members, thereby making it possible to reduce the weight of the counterweight.

DETAILED DESCRIPTION OF THE PREFERRED EMBODIMENTS

In the present invention, the object of adjusting the position of the mooring hook in a short period of time is achieved by raising and lowering the wire member which connects the rod member and the spring device which expands and contracts together with the oscillation of the door body, via the pulley attached to the piston rod of the hook attaching and detaching cylinder device.

Example

The present invention is described in detail with an example below, using FIG. 1 to FIG. 13.

Figure 1:
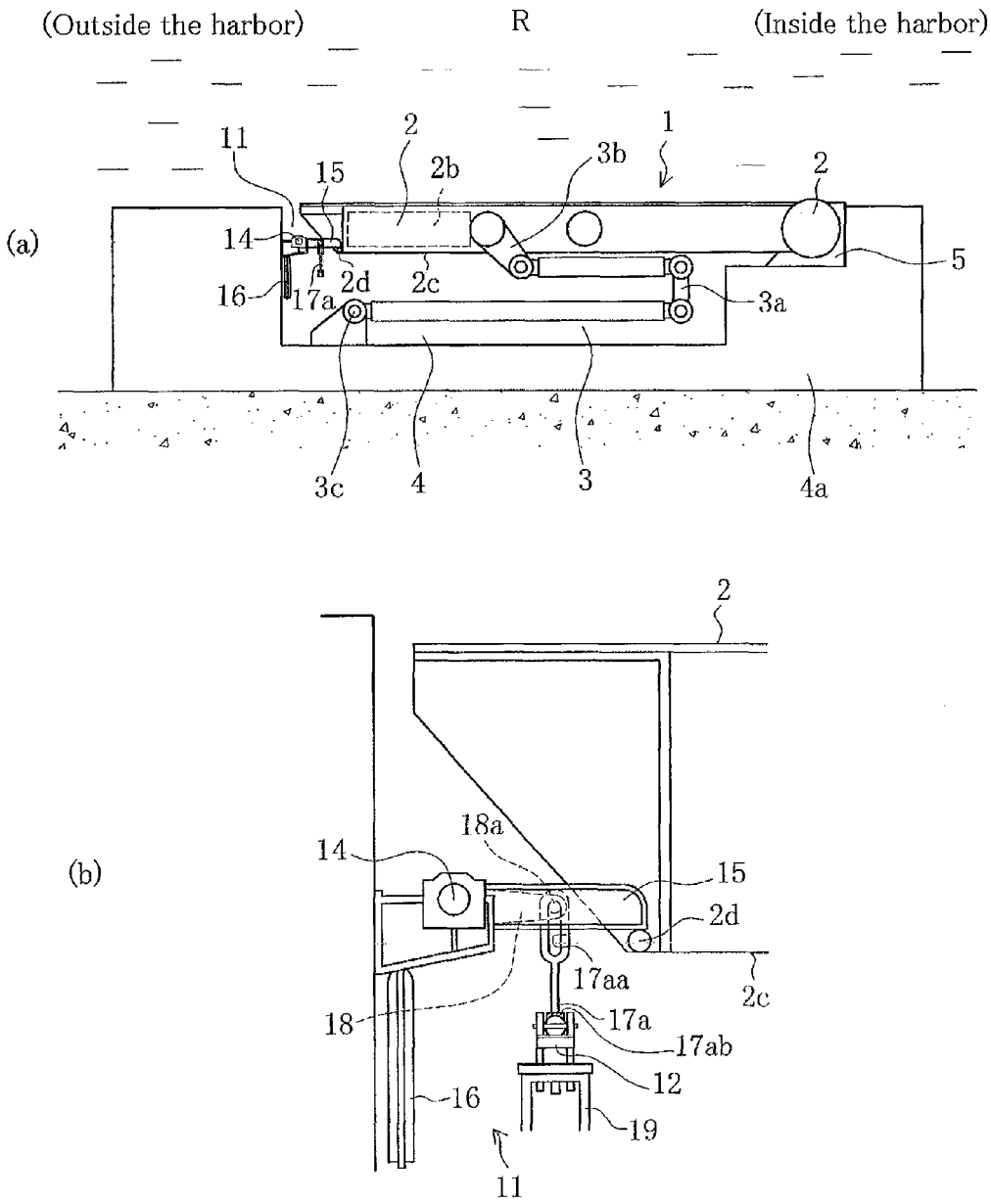
FIG. 1 (*a*) is a schematic diagram illustrating a state when a flap-gate breakwater equipped with the mooring device of the present invention is in a lowered state during mooring; (*b*) is an expanded view of the front end portion of the door body

FIG. 1 is a schematic diagram illustrating a state when a flap-gate breakwater equipped with the mooring device of the present invention is in a lowered state during mooring.

In FIG. 1, Reference Numeral 1 is a flap-gate breakwater, equipped, for example, with a door body 2 and a plurality of tension rods 3 provided on the outer side of a harbor R, so that the door body 2 will not tip while the door body 2 is being raised.

Figure 2:
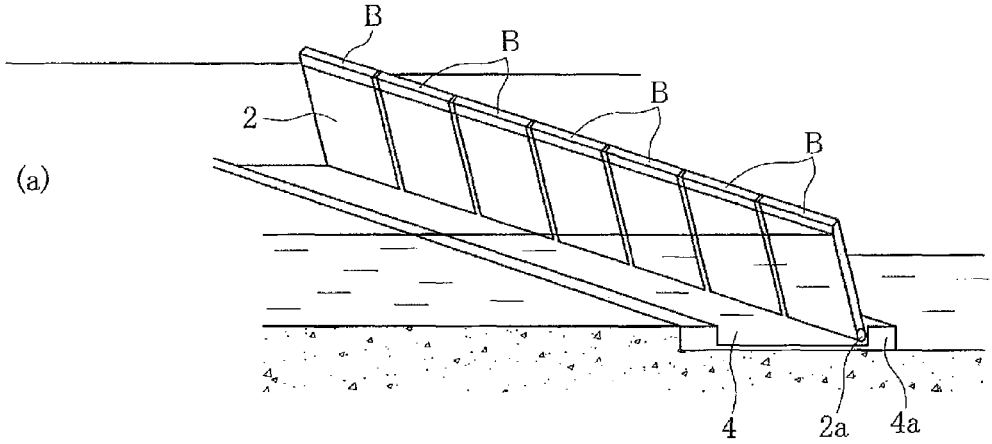
FIG. 2 is a schematic diagram illustrating a state when a flap-gate breakwater is disposed continuously along the width of a harbor, where (*a*) is a perspective view in which a tension rod is omitted, and (*b*) is a side view.
Figure 2:
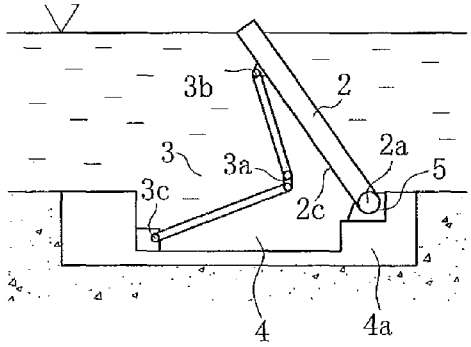

If the door body 2 is placed in the waters of a wide harbor, a plurality of laterally arranged sets forming a door body block B is provided in a row at fixed intervals, with the members of the door body block B being adjacent and connected to each other with a rope, as shown in FIG. 2 (*a*).

Figure 3:
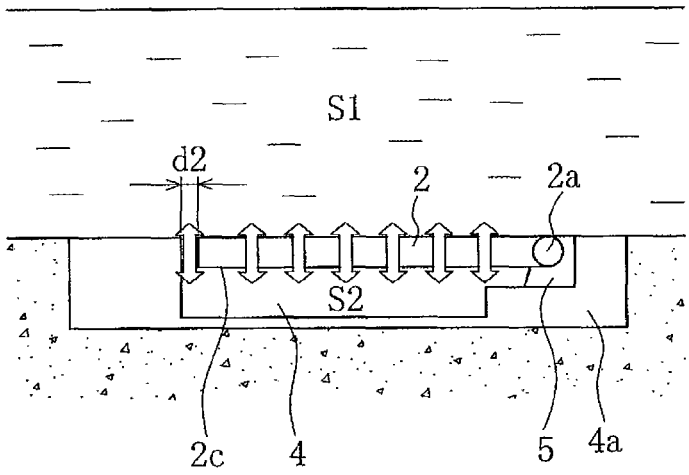
FIG. 3 is a drawing illustrating the interval between the top end of the door body and the containment structure, and the opening width of both ends of the door body block, where (*a*) is a side view, and (*b*) is an elevation view.
Figure 3:
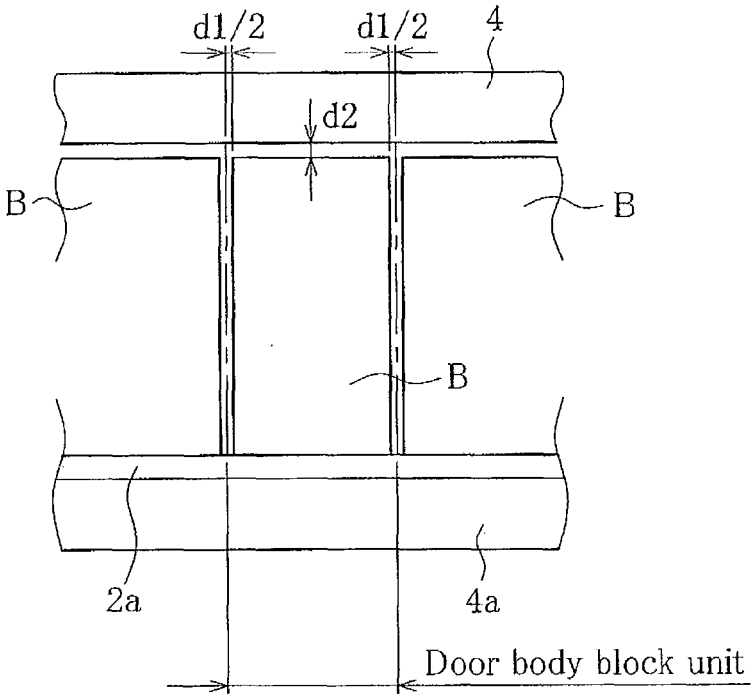

In the case of the door body 2, a door body block unit is measured from the center of one of adjacent door bodies B to the center of the other of the adjacent door bodies, and the value of the width of the door body block B subtracted from the width of the door body block unit is an opening width d1 of the two side end parts of the adjacent two door body blocks B, as shown in FIG. 3 (*b*).

The opening width d1 of the two side end parts of the adjacent two door body blocks B, is basically 1% of the width of the door body block B, so that when the flap-gate breakwater 1 serves as a tsunami-blocking countermeasure, the amount of water which leaks into the harbor during a tsunami is not too great. The size of opening width between the adjacent door body blocks B is (d1/2)×2=d1, because the door body block units are arranged in a row at fixed intervals, and is 1% of the width of the door body block B. If the opening width d1 of the two side end parts of the door body block B is too small, there arises a problem that foreign matter can get caught therein.

The door body 2 has a rotating shaft 2*a* on the base end side, which is supported by a bearing 5, so as to freely rotate on a base 4*a* of a containment structure 4 which is provided as an integral structure at the bottom of the harbor R, and the rotating shaft 2*a* serves as a supporting point for raising and lowering the door body 2.

In order to facilitate a smooth raising and lowering operation, an interval d2 is also provided between the top end of the door body 2 and the containment structure 4, as shown in FIG. 3 (*b*). Accordingly, as shown in FIG. 3 (*a*), the space S1 above the door body 2 in the lowered position and the space S2 below the door body 2 in the lowered position communicate with each other by means of the opening width d1 of the two side end parts of the adjacent two door body blocks B and the interval d2 between the top end of the door body block B and the containment structure 4.

The tension rod 3 is formed so as to fold into two, due to a connecting member 3*a* disposed in the middle thereof. One end part 3*b*, which is positioned at the upper end side when the door body 2 is raised, is supported for rotation at the upper end of the door body 2, and the other end part 3*c*, which is positioned at the lower end side when the door body 2 is raised, is supported for rotation at a position separated only by a specified distance from the rotating shaft 2*a* on the side where the door body 2 is lowered.

The door body 2 is provided with a buoyancy chamber 2*b* on the upper end side thereof, for example, and is constructed to produce the buoyancy required to raise the door body 2, by supplying air to the buoyancy chamber 2*b* by means of an air supply device (receiver tank and compressor) which is not depicted in the drawings.

Figure 4:
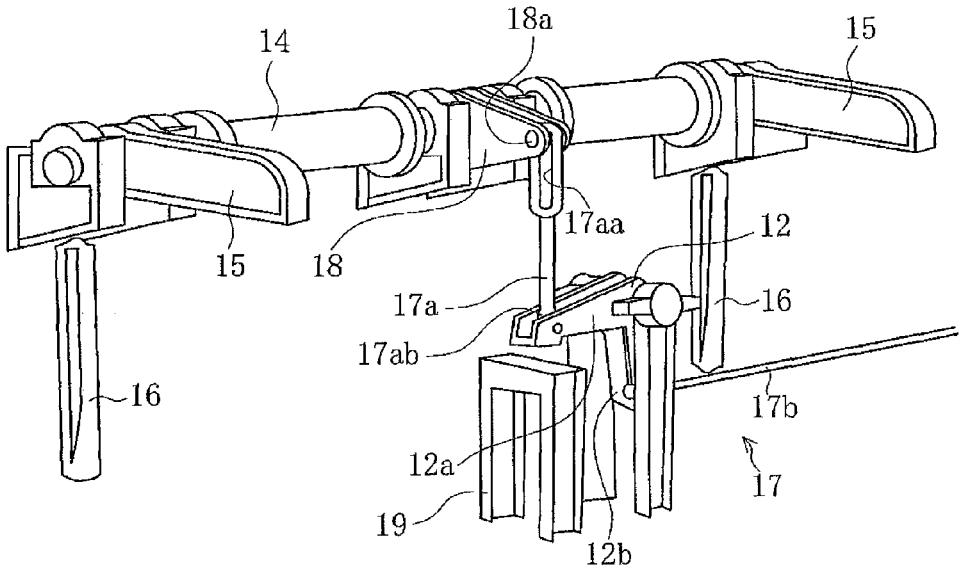
FIG. 4 is a detailed drawing of the mooring device, where (*a*) is a perspective view illustrating the configuration of the containment structure side, and (*b*) is a detailed drawing illustrating the configuration of the control device side.
Figure 4:
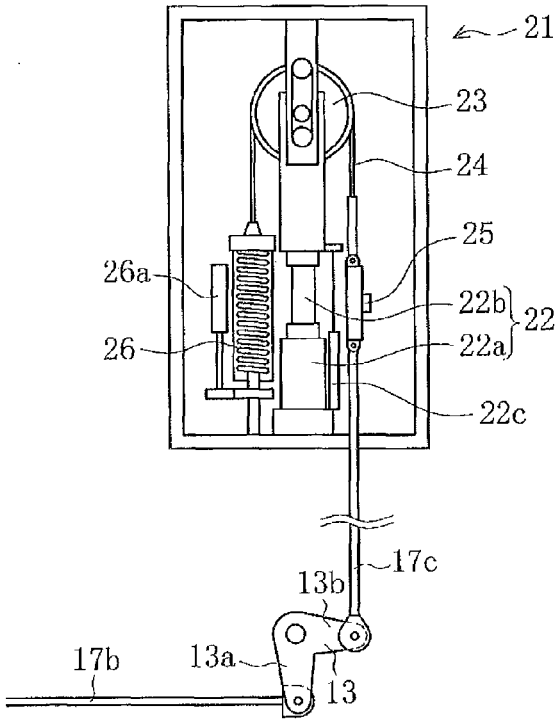
Figure 5:
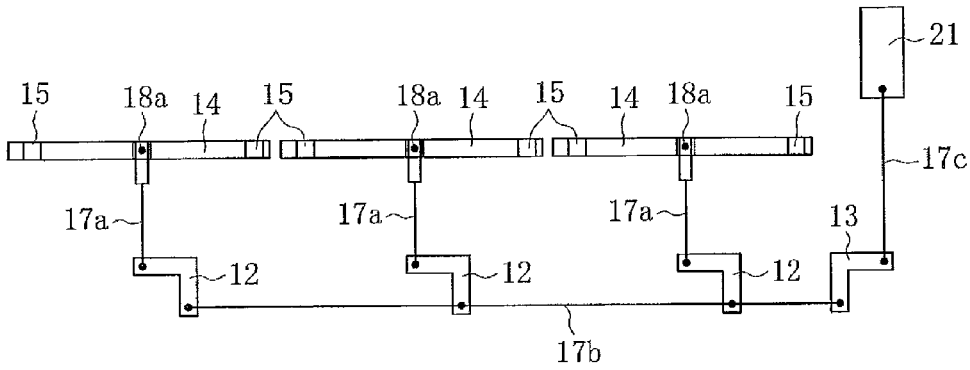
FIG. 5 is a schematic diagram illustrating the state of the mooring device when there is provided a plurality of first link members.

Reference Numeral 11 is a mooring device of the present invention which has, for example, the structure illustrated in FIG. 4, and which moors the door body 2 under the water in a state in which it has buoyancy.

Reference Numerals 12 and 13 are first and second bell crank link members, and the first link member 12 is disposed on a portion opposite to the backside 2*c* of the door body 2 in a lowered state in a containment structure 4 which moors the door body 2 under water as shown in FIG. 1 (*a*). The second link member 13 is disposed on the outer side of one end of the backside 2*c* of the door body 2 in a lowered state in the containment structure 4, at a part opposite to the backside 2*c* of the door body 2 in a lowered state while being contained.

Reference Numeral 14 is a torque shaft which freely rotates around the central axis, and is disposed in a position opposite to a gate mooring member 2*d* attached to the top end side (the upper end side of the door body 2 when it is raised), for example, on the backside 2*c* of the door body 2 in a mooring state. A mooring hook 15 is attached in a protruding state in a position to engage with the gate mooring member 2*d* of the torque shaft 14.

Reference Numeral 16 is a counterweight which is connected to the mooring hook 15 protruding to the opposite side of the torque shaft 14, and causes the torque shaft 14 to rotate in a direction which frees the mooring hook 15 from engagement with the gate mooring member 2*d*.

Reference Numeral 17 is a rod member having one end connected to the other end of a torque arm 18 having on end attached in a position in the center in the axial direction of the torque shaft 14, and having the other end pulled above the surface of the water via the first link member 12 and the second link member 13.

The rod member 17 is formed from a first vertical rod 17*a*, a horizontal rod 17*b*, and a second vertical rod 17*c*.

The first vertical rod 17*a* is provided with a slot 17*aa* at one end, and a pin 18*a* provided in a position toward the other end of the torque arm 18 is inserted into the slot 17*aa*. A spherical bushing 17*ab* is provided at the other end, is supported to rotate freely at one end part 12*a* of the first link member 12.

The horizontal rod 17*b* has one end which is supported to rotate freely at the other end part 12*b* of the first link member 12 and the other end which is supported to rotate freely at one end 13*a* of the second link member 13. If there is a plurality of first link members 12, the horizontal rod 17*b* is supported to rotate freely at the other end part 12*b* of the plurality of first link members 12, and the other end of the horizontal rod 17*b* is supported to rotate freely at one end 13*a* of the second link member 13 (see FIG. 5).

The second vertical rod 17*c* has one end which is supported to rotate freely at the other end part 13*b* of the second link member 13, and the other end is pulled above the surface of the water and is connected to a control device 21 having the structure given below.

Figure 8:
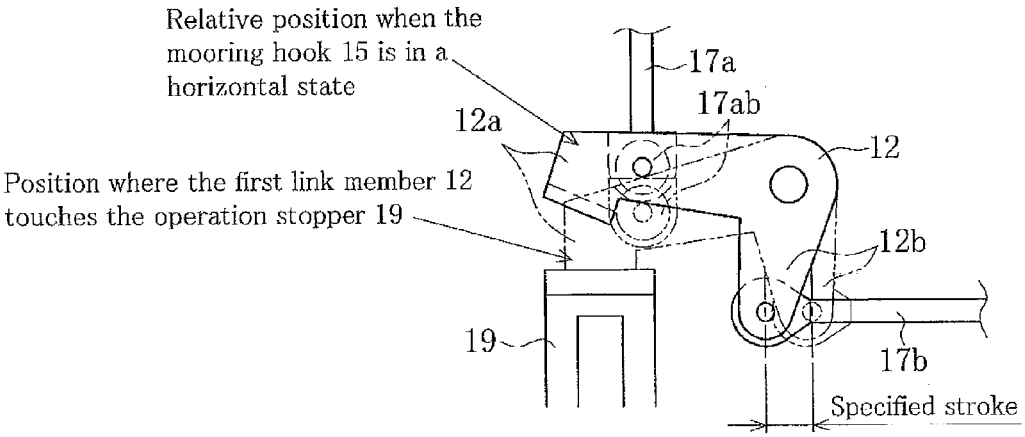
FIG. 8 is a drawing illustrating a specified stroke magnitude in the mooring preparation operation.

Reference Numeral 19 is an operation restriction stopper provided on the rotational pathway of one end part 12*a* of the first link member 12, and one end part 12*a* of the first link member 12 comes in contact with the operation restriction stopper 19 to restrict the operating range of the first link member 12 (see FIG. 8).

Reference Numeral 22 is a hook attaching and detaching cylinder device for attaching and detaching the mooring hook 15 to the gate mooring member 2*d*, and is disposed near the other end of the second vertical rod 17*c*. The hook attaching and detaching cylinder device 22 has a pulley 23 attached to the front end of a piston rod 22*b* which projects into and retracts from a cylinder 22*a* with a fixed bottom.

Reference Numeral 24 is a wire member wound around the pulley 23, and one end thereof is connected to the other end of the second vertical rod 17*c* via a load cell 25, and the other end thereof is connected to a device such as a spring device 26 which expands and contracts together with the oscillation of the door body 2. A spring used in the spring device 26 is a coil spring having a slender metal wire wrapped in a spiral. The wire member 24 does not have to be replaced under water when it stretches, since this can be accomplished on land.

The hook attaching and detaching cylinder device 22 is provided with a stroke sensor 22*c* for detecting the amount of projection and retraction of the piston rod 22*b*. The spring device 26 is also provided with a stroke sensor 26*a* and a stroke indicator for measuring the stroke of the spring.

In the case of the mooring device 11 constructed as described above, when waves pass over the door body 2 moored in the containment structure 4, oscillations caused by buoyancy generated in the door body 2 cancel out the wave force allowed by the expansion and contraction of the spring device 26.

The flap-gate breakwater 1 described above moors the door body 2 and releases it from mooring by the operation described as follows.

Mooring Preparation Operation: See FIG. 6-FIG. 8

Figure 6:
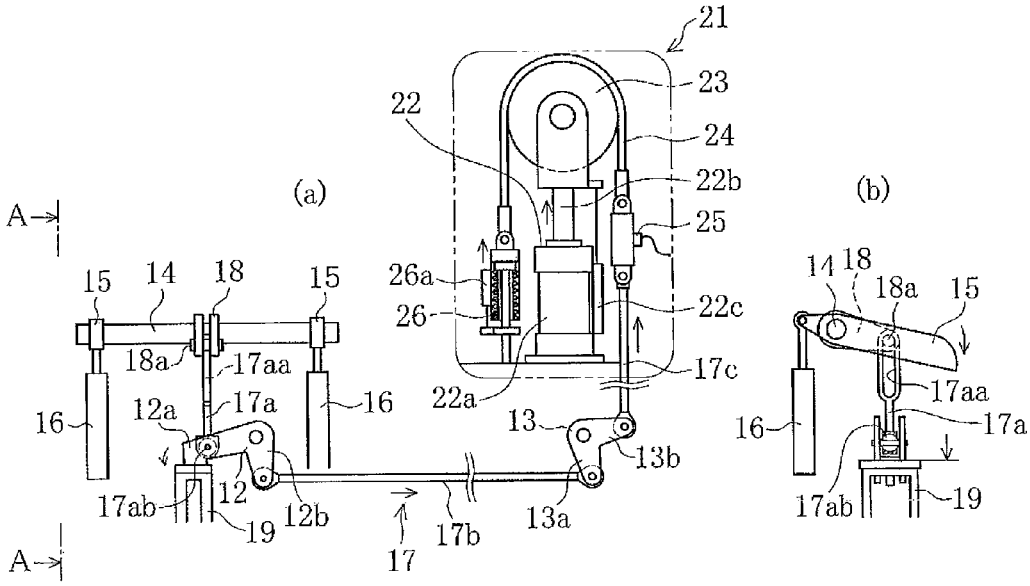
FIG. 6 (*a*) is a drawing illustrating the state of the mooring device during the mooring preparation operation, and (*b*) is a view along the line A-A in (*a*).
Figure 7:
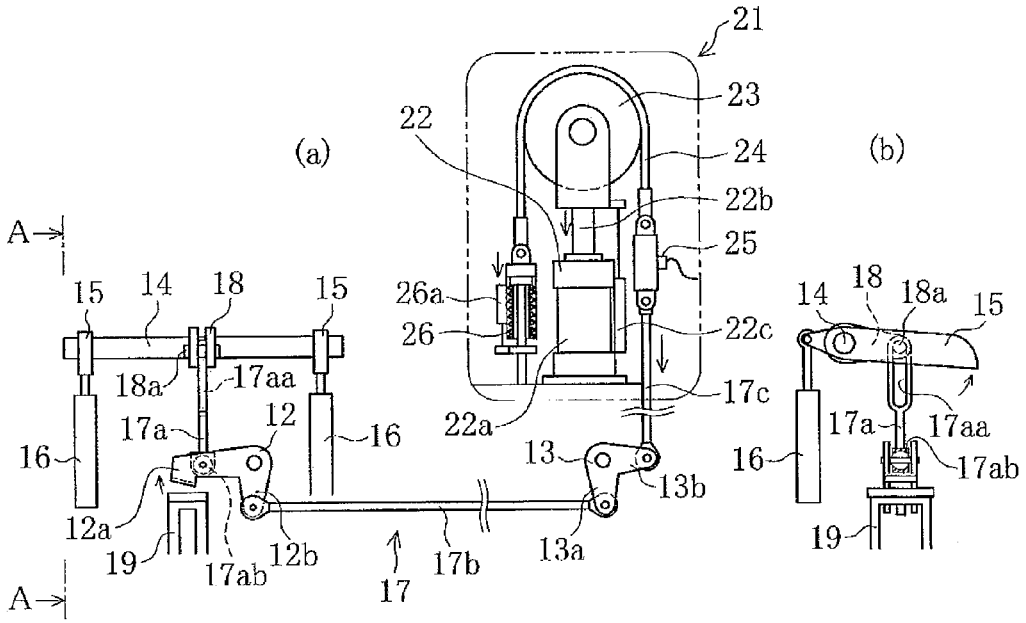
FIG. 7 (*a*) is a drawing illustrating the state of the mooring device after completion of the mooring preparation operation, and (*b*) is a view along the line A-A in (*a*).

The piston rod 22*b* of the hook attaching and detaching cylinder device 22 is activated, and one end part 12*a* of the first link member 12 is caused to make contact with the operation restriction stopper 19 (see FIG. 6)

Then, while monitoring the stroke sensor 26*a* of the spring device 26 or the load cell 25, the piston rod 22*b* of the hook attaching and detaching cylinder device 22 is activated until a mooring force operates that is equivalent to when the standard buoyancy operates when the door body 2 is moored. The stroke position of the piston rod 22*b* of the hook attaching and detaching cylinder device 22 at that time is detected by the stroke sensor 22*c*, and is recorded as the standard position. A mooring force which is equivalent to when the standard buoyancy operates when the door body 2 is moored is referred to below as the specified mooring force.

At this time, the link members among the control device 21 from the operation restriction stopper 19 and a spring device system are in a stretched state equivalent to the specified mooring force. The spring device system refers to the first link member 12, the rod members 17*b*, 17*c*, the second link member 13, the load cell 25, the wire member 24, and the spring device 26.

The relative positional relationship between the first link member 12 and the mooring hook 15 is then understood. Therefore, the piston rod 22*b* of the hook attaching and detaching cylinder device 22 is withdrawn by an amount corresponding to the specified stroke, in the position of the first link member 12 in the standard position recorded as above (see FIG. 8). The amount corresponding to the standard stroke refers to an amount from when the first link member 12 is in a position (imaginary line) touching the operation restriction stopper 19 to the relative position when the mooring hook 15 is in a horizontal state (solid line).

In the above state, when the piston rod 22*b* of the hook attaching and detaching cylinder device 22 is withdrawn by the amount corresponding to the standard stroke, first, the stretched link members and the spring device system contract. After that, one end part 12*a* of the first link member 12 separates from the operation restriction stopper 19. The mooring hook 15 reaches a position inclining downward from the horizontal position, in an amount corresponding to the contraction of the link members and the spring device system (see FIG. 7). This completes the mooring preparation operation.

Figure 9:
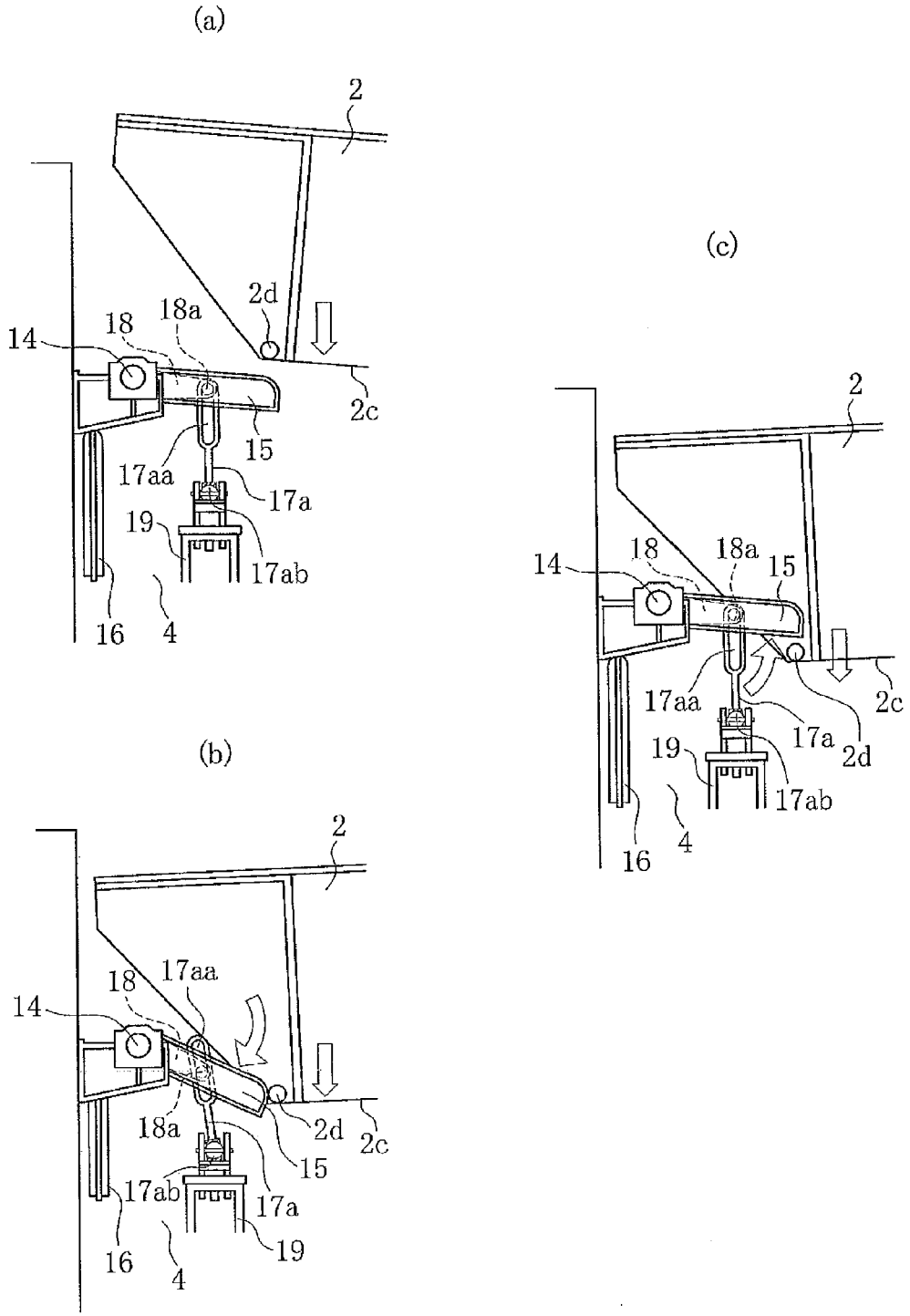
FIGS. 9 (*a*)-(*c*) are drawings which sequentially illustrating the relative positions of the mooring hook and the gate mooring pin, as the door body is lowered.
Figure 10:
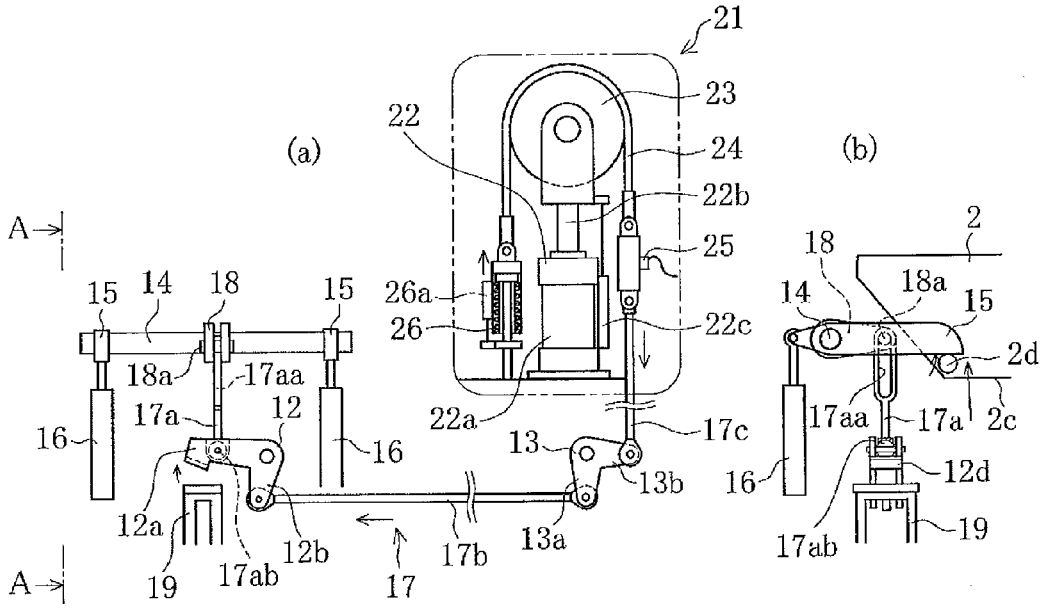
FIG. 10 (*a*) is a drawing illustrating the state of the mooring device when mooring is completed, and (*b*) is a drawing illustrating the relative position of the mooring hook and the gate mooring pin as viewed from the direction A-A in (*a*).
Figure 11:
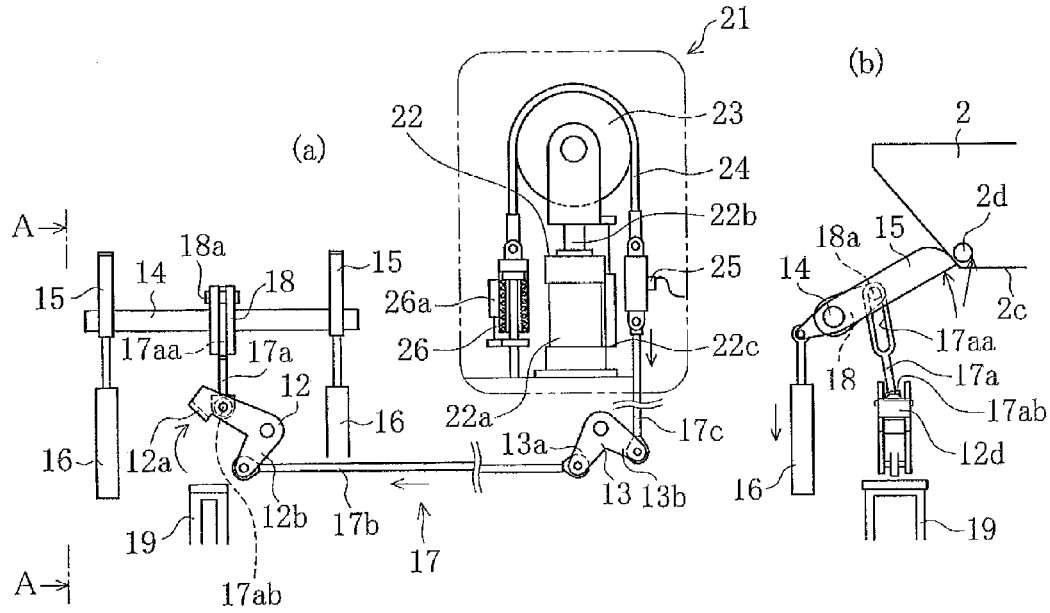
FIG. 11 (*a*) is a schematic diagram illustrating the state of the mooring device when the mooring of the door body is released, and (*b*) is a view along the line A-A in (*a*).
Figure 12:
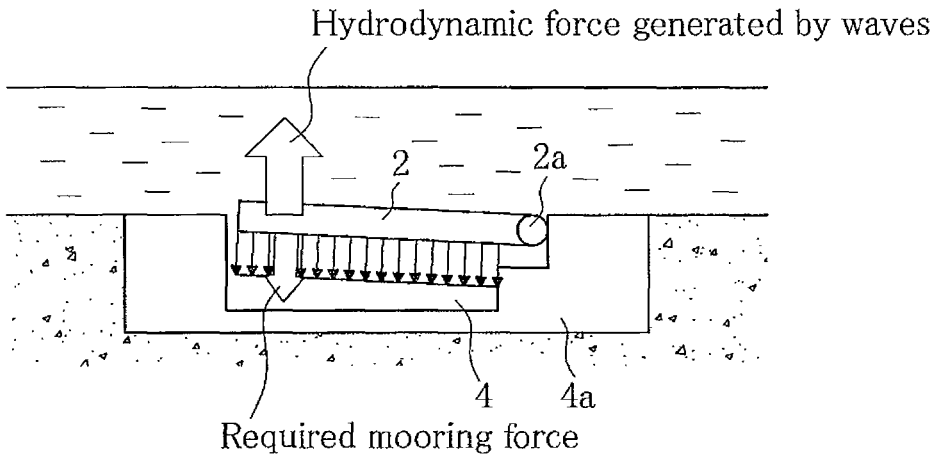
FIG. 12 is a diagram illustrating the mooring force required when the door body is allowed to oscillate.

Mooring Operation: FIG. 9-FIG. 10

Upon completion of the above mooring preparation operation, an exhaust valve provided to the upper end of the door body 2 is opened, air is removed from the buoyancy chamber 2*b*, sea water enters the buoyancy chamber 2*b*, and the door body 2 is lowered.

With the lowering of the door body 2, the gate mooring member 2*d* provided to the door body 2 pushes down on the mooring hook 15, and at the same time, the pin 18*a* of the torque arm 18 moves toward the lower part of the slot 17*aa* of the first vertical rod 17*a* (see FIG. 9 (*a*)-9 (*b*)). Meanwhile, movement along the slot 17*aa* of the pin 18*a* of the torque arm 18 is accomplished smoothly, because the first vertical rod 17*a* oscillates as a supporting point for the spherical bushing 17*ab*.

When the gate mooring member 2*d* of the door body 2 passes the mooring hook 15, the mooring hook 15 crosses the gate mooring member 2*d*, due to the weight of the counterweight 16, and returns from the horizontal state to a position inclined slightly downward (FIG. 9 (*c*)).

After lowering is completed, compressed air is supplied to the buoyancy chamber 2*b*, and sea water is expelled from the buoyancy chamber 2*b*. Consequently, the door body 2 rises, and the gate mooring member 2*d* pushes the mooring hook 15 upward, transmitting the buoyancy of the door body 2. At the same time, the rod member 17, the first link member 12, the second link member 13, the wire member 24, and the spring device 26 are stretched and displaced by the mooring force resulting from the buoyancy of the door body 2. The mooring hook 15 moves upward by the amount of displacement (FIG. 10).

Then, the stroke sensor 26*a* of the spring device 26 or the load cell 25 is monitored to confirm that the specified mooring force is in operation, and the supply of air to the buoyancy chamber 2*b* is stopped. When this happens, the mooring hook 15 reaches a horizontal state.

The stroke of the hook attaching and detaching cylinder device 22 can be reduced, because the control device 21, which is provided on land, no longer needs to operate with regard to the series of mooring operations described above. Additionally, the weight of the counterweight 16 can be reduced, because there is no need to operate the link members 12, 13 and the rod member 17 by means of the counterweight 16.

Furthermore, in cases where the rod member 17, the first link member 12, and the second link member 13 have undergone changes such as stretching, deflecting, or the like, if the above-described series of mooring preparation operations are performed each time prior to the mooring operation, the position of the mooring hook 15 can be kept constant, without visually checking the position of the mooring hook 15 when it is under water, thereby making it possible to always maintain a normal mooring state.

During the Operation of Raising the Door Body 2: See FIG. 11

When the hydraulic pressure of the hook attaching and detaching cylinder device 22 is released, the holding force is relaxed. Consequently, the mooring force of the mooring hook 15 is relaxed via the second vertical rod 17*c*, the second link member 13, the horizontal rod 17*b*, the first link member 12, the first vertical rod 17*a*, and the torque arm 18. Therefore, the mooring hook 15 is pushed upward by the buoyancy of the door body 2 and the force of the counterweight 16, releasing engagement with the gate mooring member 2*d*.

After that, it is confirmed that the spring device 26 has contracted, and the load cell 25 confirms that there is no mooring force.

In the flap-gate breakwater 1 described above, oscillation of the door body 2 is allowed by the spring device 26, so that mooring is performed. In this case, negative pressure occurs in the space S2 on the lower side of the door body 2, as a result of the upward displacement of the door body 2, generating a force which operates downward on the door body 2 as a result of the difference in pressure vis-à-vis the upper surface of the door body 2 (see FIG. 12).

Figure 13:
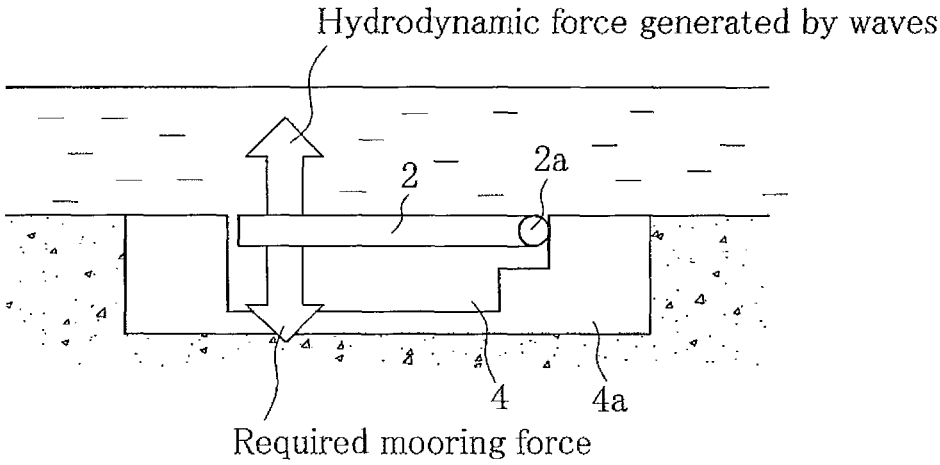
FIG. 13 is a diagram illustrating the mooring force required to keep the door body in a lowered state.

Accordingly, the load required to moor the door body 2 is less than in the case where mooring is accomplished when the door body 2 whose the mooring mechanism must entirely bear the operating load in the form of momentum around the rotating shaft 2*a* of the door body 2 generated by a wave is fixed in place (see FIG. 13).

The present invention is not limited to the above-described example, and the preferred embodiment may, of course, be advantageously modified within the scope of the technical ideas recited in the claims.

EXPLANATION OF THE REFERENCE SYMBOLS

B Door body block
1 Flap-gate breakwater
2 Door Body
2*a* Rotating shaft
2*b* Buoyancy chamber
2*c* Backside
2*d* Gate mooring member
4 Containment structure
5 Bearing
11 Mooring device
12 First Link member
13 Second Link member
14 Torque shaft
15 Mooring hook
16 Counterweight
17 Rod member
17*a* First Vertical rod
17*aa* Slot
17*ab* Spherical bushing
17*b* Horizontal rod
17*c* Second Vertical rod
18 Torque arm
19 Operation restriction stopper
22 Hook attaching and detaching cylinder device
22*b* Piston rod
23 Pulley

24 Wire member

26 Spring device

The invention claimed is:

1. A mooring device for a flap-gate breakwater having a door body with a plurality of sets of door body blocks arranged in a width direction, the door body being moored in a state of buoyancy, and raised by releasing the mooring, comprising:

a torque shaft disposed so as to freely rotate around a central axis, in a position opposite to a gate mooring member attached to a backside of the door body in a mooring state;

a mooring hook installed on the torque shaft to protrude in a position to engage with the gate mooring member;

a counterweight attached to the torque shaft for rotating the torque shaft in a direction to release the mooring hook from engaging with the gate mooring member;

a first link member disposed on the opposite portion to the backside of the door body in a mooring state in a containment structure which moors the door body under water;

a second link member disposed on an outer side of the other side of the backside of the door body in a mooring state in the containment structure;

a rod member having one end connected in a position toward the other end of a torque arm with one end attached to the torque shaft, and having the other end pulled above the surface of the water via the two link members;

a hook attaching and detaching cylinder device having a pulley attached to the front end of a piston rod, and near the other end of the rod member;

a wire member, one end of which is connected to the other end of the rod member, and the other end of which is connected via the pulley to a spring device which expands and contracts together with the oscillation of the door body; and a vertical rod forming the rod member, one end of which pivots at a position toward the other end of the torque arm, and the other end of which pivots at the one end of the first link member, and having a slot at the one end and a spherical bushing at the other end, wherein when it is time to activate mooring of the door body, while oscillating around the spherical bushing oscillating as a supporting point, a pin attached to a position toward the other end of the torque arm moves along the slot, from the time when the gate mooring member starts to press down on the front end of the mooring hook, until the time when the front end of the mooring hook crosses the gate mooring member, to thereby accommodate vertical movements of the mooring hook.

2. The mooring device for a flap-gate breakwater according to claim 1, wherein a stopper is disposed on a rotational pathway of one end part of the first link member to restrict rotation of the first link member.

* * * * *